United States Patent [19]

Wray, Jr.

[11] Patent Number: 4,866,565

[45] Date of Patent: Sep. 12, 1989

[54] VACUUM CLEANER ELECTROSTATIC BUILD UP CONTROL SYSTEM

[75] Inventor: Charles C. Wray, Jr., Bristol, Ind.

[73] Assignee: The Kent Company, Elkhart, Ind.

[21] Appl. No.: 296,677

[22] Filed: Jan. 13, 1989

[51] Int. Cl.[4] ..... H05G 3/02

[52] U.S. Cl. ..... 361/215; 361/220; 174/47; 15/339

[58] Field of Search ..... 361/212, 215, 220; 174/47; 15/339

[56] References Cited

U.S. PATENT DOCUMENTS

| | | | |
|---|---|---|---|
| 2,263,221 | 11/1941 | Merrill | 361/215 |
| 3,343,154 | 9/1967 | Seesselberg | 361/215 X |
| 4,473,923 | 10/1984 | Neroni et al. | 174/47 X |
| 4,697,300 | 10/1987 | Warlop | 361/215 X |
| 4,715,085 | 12/1987 | Johanson | 361/212 X |
| 4,715,086 | 12/1987 | Johanson et al. | 361/212 X |

*Primary Examiner*—L. T. Hix
*Assistant Examiner*—Brian W. Brown
*Attorney, Agent, or Firm*—Alfred E. Miller

[57] ABSTRACT

A wire molded into the wall of a vacuum cleaner hose and having electrical conductivity through the vacuum cleaning system by metal to metal conduct and additionally being provided with a grounding cable connected to an external ground bar for dissipating any electrostatic charges built up in the vacuum cleaning system. The vacuum cleaning tools used with the system are at least partially fabricated of static discharging materials in order to further prevent static build-up in the vacuum cleaning system.

5 Claims, 4 Drawing Sheets

VACUUM CLEANER ELECTROSTATIC BUILD UP CONTROL SYSTEM

The present invention relates to an arrangement or system devised to provide an effective means for controlling and preventing electrostatic discharge since, discharges of that type can be very damaging to electronic equipment, as well as dangerous and hazardous to the operator. Consequently, the use of an effective means for controlling and preventing electrostatic discharge is imperative in high risk areas, such as hospitals and nursing homes. Since the operator of the vacuum system for cleaning large areas may need to use hoses up to 50 feet long, it is desirable to incorporate an arrangement in which static buildup is controlled or eliminated.

It is an object of the present invention to provide an anti-static vacuum system in which electric conductivity is maintained from the end of a vacuum cleaner hose having a conductive wire therein to the various vacuum cleaner tools by metal to metal contact.

The basic conductive hose assembly for a tank type vacuum cleaner is preferably a PVC hose having stranded copper wire molded into the wall of the hose. The ends of the stranded copper wire pass through hose cuffs on opposite ends of the hose and are in contact with metal ferrules that are glued or otherwise epoxied to the hose cuffs.

It is another object of the present invention to prevent static buildup by utilizing a grounding cable in which one end is connected to a grounding stud on the conductive hose assembly while the other end of the grounding cable is attached to an external ground bar.

Another object of the present invention is to provide a kit of vacuum cleaning tools, such as brushes or the like, having covers of static dissipating materials.

It is known that the removal of debris in enclosed areas containing computer equipment, and especially around computer circuit boards, by the usual vacuum cleaning systems can result in static discharge. Consequently, it is a further object of the present invention to effectively eliminate static electricity from damaging circuit boards in computer installations without a reduction in the efficiency of the vacuum system.

It is a further object of the present invention to provide a tool kit for attachment to a wand of a vacuum cleaner hose assembly, in which the various tools, such as dust brushes and crevice tools are provided with a cover of a static dissipating polycarbonate.

In order for the invention to be more clearly understood it will be disclosed in greater detail with reference to the accompanying drawings, wherein.

Figure 6:
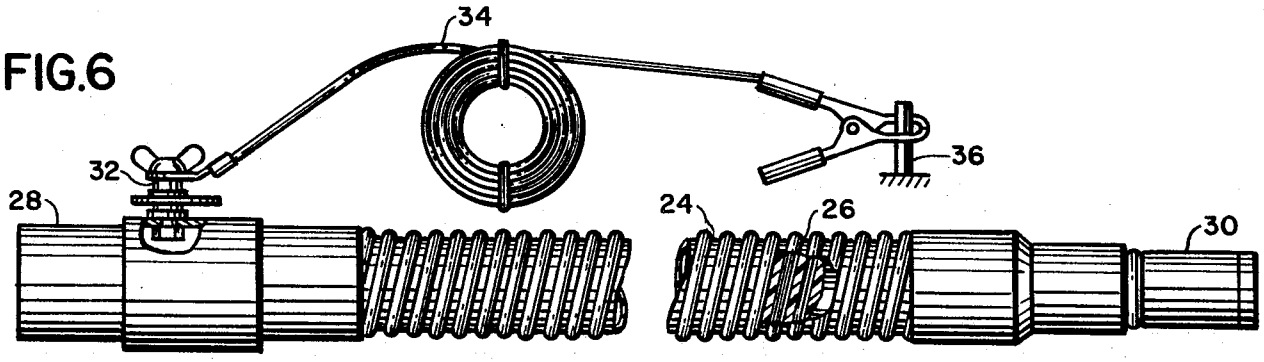
FIG. 6 shows a conductive hose with a grounding wire connected to a grounding stud.
Figure 7:
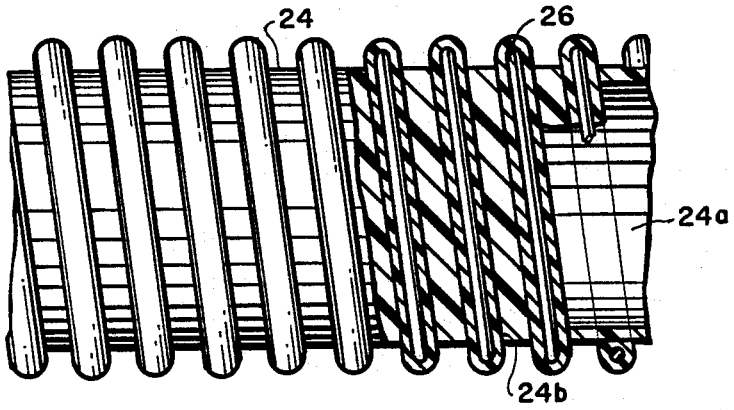
FIG. 7 is an enlarged view of the conductive hose with part thereof broken away to show the conductive wire invented therein.
Figure 8:
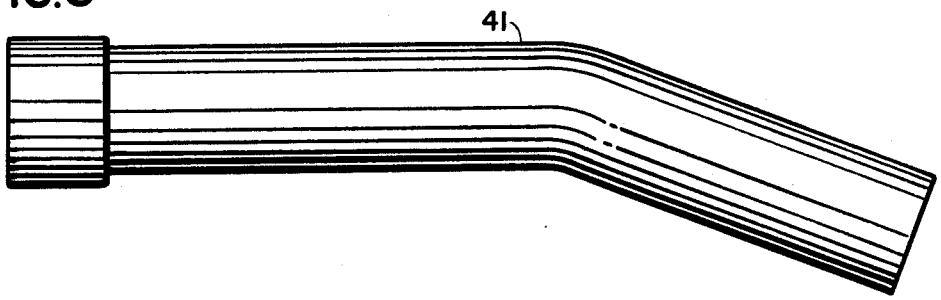
FIG. 8 is a side elevational view of the rigid wand adapted to be connected to the hose assembly.

As seen in the figures, the reference numeral 10 refers to a tank type vacuum cleaner of the well known type having a filter system (not shown), also of a known type. In inlet 12, preferably has a 2 inch diameter. Attached to the inlet is a 2 inch diameter hose assembly 14, having metal locking ferrules 16 and 18 at opposite ends. Also shown is a 2 inch diameter locking hose coupler 20, which is preferably fabricated of aluminum and is provided with spring-loaded locking pins 22. The coupling 20 couples a 2 inch hose to the 1½ inch diameter conductive hose 24, which is preferably fabricated of clear vinyl, and has a stranded copper wire 26 molded into the hose as seen in FIG. 7. In addition, it should be noted that the hose 24 is provided with an interior hollow space **24*a* and helical turns 24*b* on the outer surface of the hose 24. The conductive hose 26, also has metal ferrules 28 and 30 on opposite ends thereof. The metal ferrules are connected to the copper wire 26, in order to maintain electrical conductivity. The locking ferrule 28 is provided with a grounding stud 32 to which is attached a grounding wire 34, whose end is secured to a separate ground bar 36, as seen in FIG. 6. Thus, it should be evident that the 1½ inch diameter hose assembly is grounded to a separate ground bar when connected directly to the tank vacuum device 10. In the diffuser lid 38 of the tank vacuum 10, a continuity test light 39** is mounted to indicate the grounding connections between the vacuum cleaner tank to the grounding bar.

Figure 1:
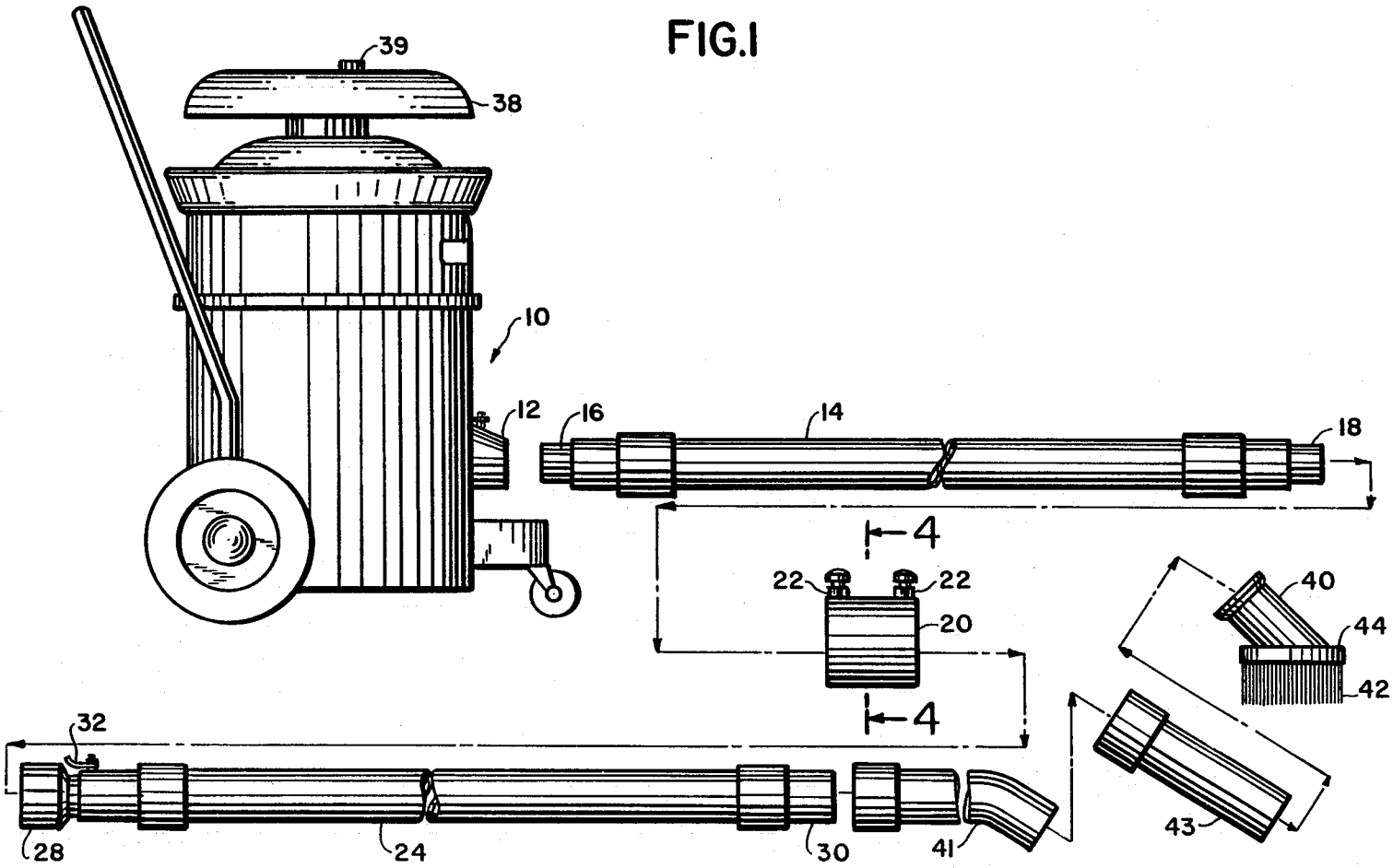
FIG. 1 is an exploded view of the tank type vacuum cleaner with the vacuum cleaner hose and wand of a vacuum cleaner hose assembly and showing a dust brush attachment constructed in accordance with the teachings of the present invention.
Figure 2:
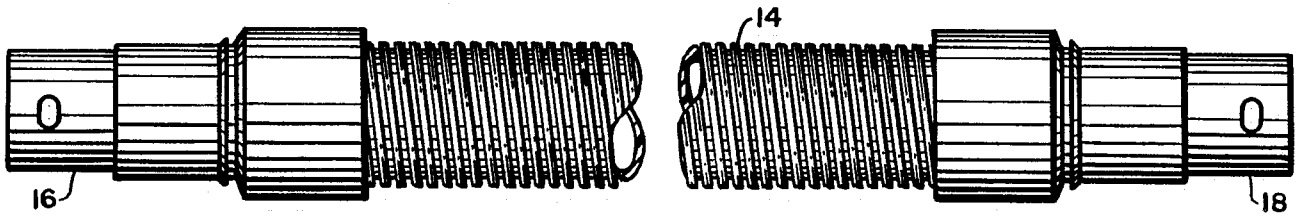
FIG. 2 is an enlarged view of a section of the conductive hose of the present invention.
Figure 4:
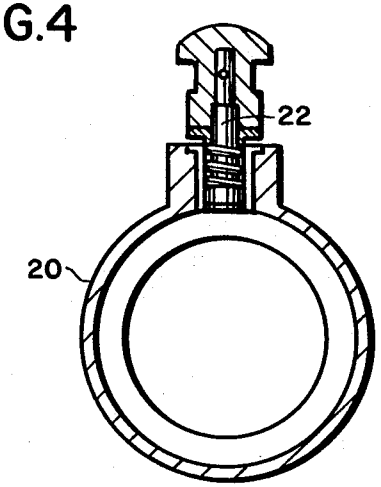
FIG. 4 is front elevational view of the locking ferrule shown in FIG. 3.
Figure 3:
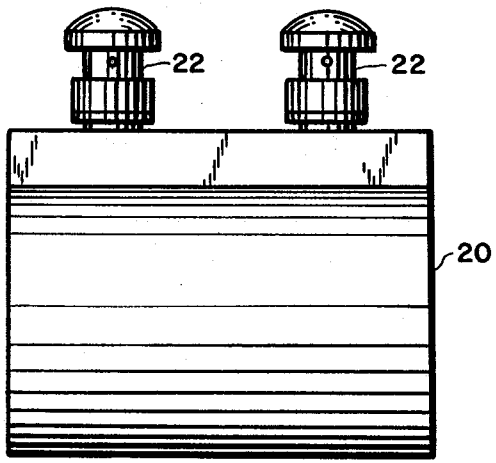
FIG. 3 is an enlarged side elevational view of the locking ferrule of FIG. 3.
Figure 5:
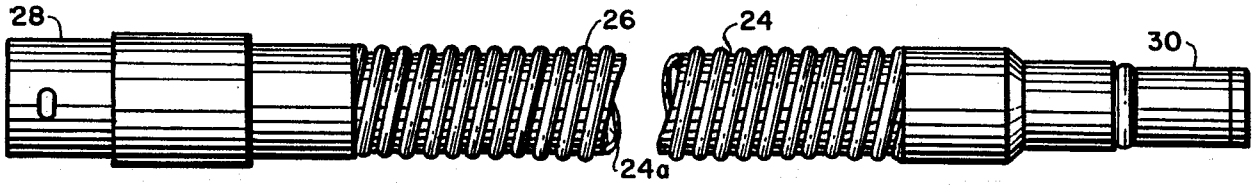
FIG. 5 is a side elevational view of another section of the conductive hose.
Figure 9:
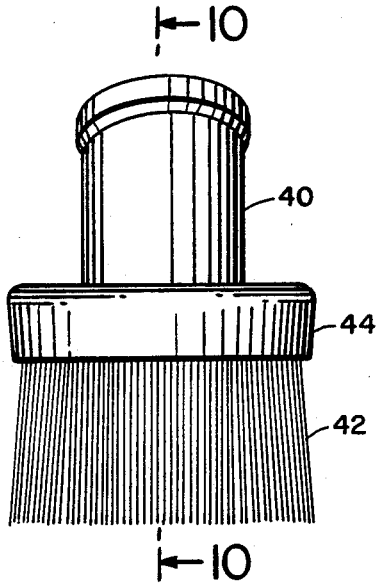
FIG. 9 is an elevational view of one of the tools that can be used with the present hose and wand assembly of the vacuum system.
Figure 10:
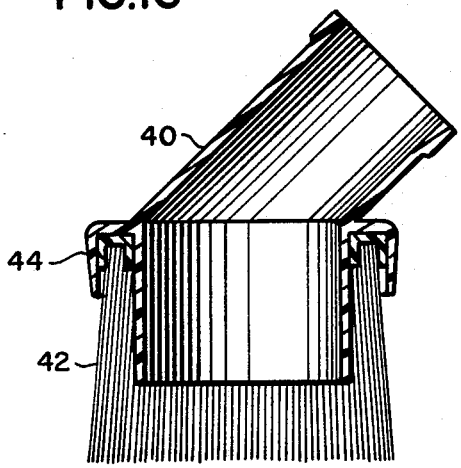
FIG. 10 is taken along the lines 10—10 of FIG. 9.

Several tools can be alternately used in connection with the present vacuum system, and is attached to metal wand sections 41 and 43, which in turn are removably secured to the hose assembly. As seen in FIGS. 1, 9 and 10, a dust brush 40 is provided with bristles 42 and a brush cover 44 of a special static dissipating polycarbonate, or other static discharge material. Of course, other types of tools can be used alternately with the present vacuum cleaning system, which may be for example, a crevice tool, or a straw tool.

It should be apparant that although dust brush 40 is shown being utilized in connection with the present vacuum system, other tools can be substituted therefore as set forth above. However all of these tools are provided with covers of static discharge material so that any static charge that are present or built up in the vacuum system or hose arrangement will be grounded or dissipated to effectively eliminate the static electricity created in the vacuum system from damaging sensitive electronic equipment present in the rooms being vacuumed.

While the invention has been disclosed and described herein with reference to certain embodiments of the invention, it is apparent that variations and modifications may be made which will fall within the true spirit and scope of the invention as defined in the following claims:

I claim:

1. A static discharge protected system comprising a vacuum cleaning machine, a vacuum cleaning conductive hose assembly and at least one metal wand connected to said vacuum cleaning machine, said hose being provided with a wire molded in the wall of said hose, an electrically conductive ferrule at opposite ends of said hose assembly being connected to said wire in order to maintain uninterrupted electrical conductivity from said vacuum system to the free end of said metal wand, a tool removably attached to the free end of said metal wand having at least part which is fabricated of a static dissipating material, and a means for separately grounding at least part of said hose assembly.

2. A static discharge protected system as claimed in claim 1 wherein said means for separately grounding is a wire connected at one end to one of said electrically conductive ferrules and is provided with a grounding bar at the other end thereof.

3. A static discharge protected system as claimed in claim 1 wherein said electrically conductive ferrule is metal.

4. A static discharge protected system as claimed in claim 1 wherein said wire molded in the wall of said hose is stranded copper wire.

5. A static discharge protected system comprising a vacuum cleaning machine, a vacuum cleaning conductive hose assembly and at least one metal wand connected to said vacuum cleaning machine, said hose being provided with a wire molded in the wall of said hose, an electrically conductive ferrule at opposite ends of said hose assembly being connected to said wire in order to maintain uninterrupted electrical conductivity from said vacuum system to the free end of said metal wand, a tool removably attached to the free end of said metal wand having a cover which is fabricated of a static dissipating polycarbonate material, and a grounding wire connected to one of said ferrules for grounding at least part of said hose assembly.

* * * * *